United States Patent [19]

Bijttebier et al.

[11] 4,348,018

[45] Sep. 7, 1982

[54] METHOD AND APPARATUS FOR THE SEPARATION OF FLEXIBLE SHEETS FROM A STACK AND THEIR TRANSPORTATION TO A PROCESSING UNIT

[75] Inventors: Gaspar A. H. Bijttebier, Grote Heerweg, 64, B-8749 Waregem-Beveren, Belgium; Jozef Vangheluwe, Roeselare, Belgium

[73] Assignee: Gaspar A. H. Bijttebier, Waregem-Beveren, Belgium

[21] Appl. No.: 64,514

[22] Filed: Aug. 7, 1979

[30] Foreign Application Priority Data

Aug. 10, 1978 [NL] Netherlands ..... 7808345

[51] Int. Cl.[3] ..... B65H 3/22; B65H 5/14; B65H 9/04

[52] U.S. Cl. ..... 271/10; 271/18.3; 271/204; 271/233; 271/236; 271/275; 271/277; 271/162; 198/692

[58] Field of Search ..... 271/18.3, 10, 233, 234, 271/236, 277, 275, 16, 17, 162, 164, 146, 210, 198, 1, 9, 19, 24, 25, 204, 206, 205; 198/692, 693

[56] References Cited

U.S. PATENT DOCUMENTS

| | | | |
|---|---|---|---|
| 1,893,736 | 1/1933 | Federwitz et al. | 271/206 |
| 2,070,297 | 2/1937 | Preston | 271/10 |
| 2,494,075 | 1/1950 | Weyandt | 271/210 |
| 3,411,772 | 11/1968 | Royin | 271/236 |
| 3,924,849 | 12/1975 | Murakami | 271/277 |
| 3,940,125 | 2/1976 | Morton | 271/10 |
| 3,977,673 | 8/1976 | Seto | 271/277 |
| 3,981,495 | 9/1976 | Bijttebier | 271/18.3 |
| 3,989,239 | 11/1976 | Scriven et al. | 271/204 |
| 4,119,306 | 10/1978 | Bijttebier | 270/58 |
| 4,136,865 | 1/1979 | Marass | 271/204 X |
| 4,143,871 | 3/1979 | Blessing | 271/18.3 X |
| 4,176,832 | 12/1979 | Hughes et al. | 271/236 X |

FOREIGN PATENT DOCUMENTS

| | | | |
|---|---|---|---|
| 848591 | 11/1976 | Belgium . | |
| 989490 | 4/1965 | United Kingdom | 271/97 |

*Primary Examiner*—Bruce H. Stoner, Jr.
*Attorney, Agent, or Firm*—Shlesinger, Arkwright, Garvey & Dinsmore

[57] ABSTRACT

A method and apparatus for separating and individually transporting flexible sheets from a stack to at least one processing unit wherein one stack edge is compressed and the topmost sheet is picked-up by pick-up heads at its edge situated at the compressed stack edge, the engaged edge is lifted from the stack, and the lifted edge is gripped by horizontally moving removal elements which remove the partially lifted sheet from under the pick-up heads and carry it away in a horizontal direction at least beyond the pick-up zone whereby the sheet is progressively turned and rolled off the stack and transported to a registering mechanism where the sheet is oriented in a predetermined position for feeding to the processing unit.

39 Claims, 12 Drawing Figures

Fig. 3
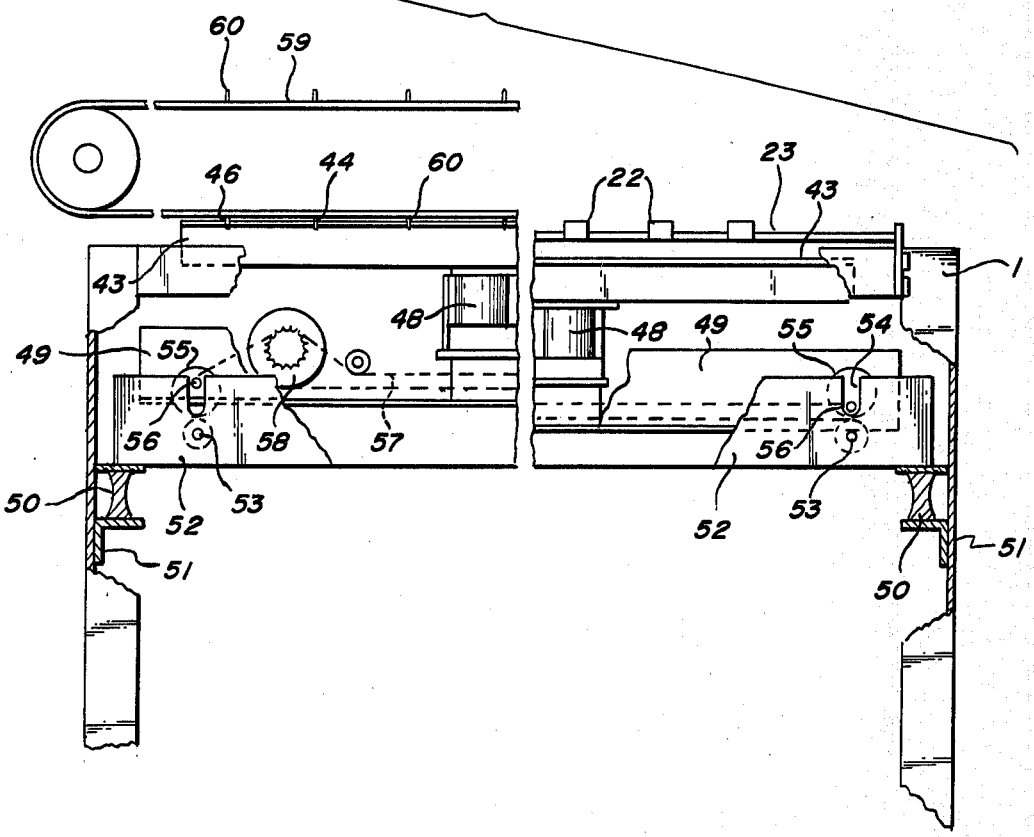
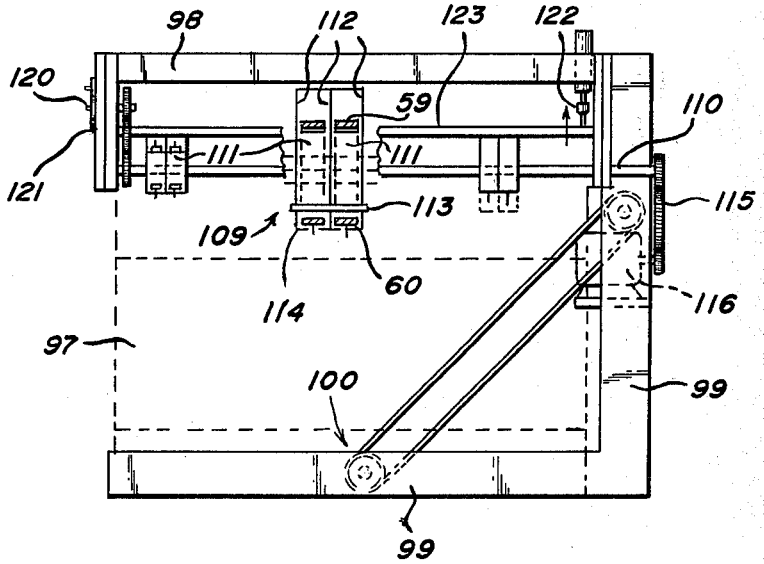
Fig. 10

Fig. 5a
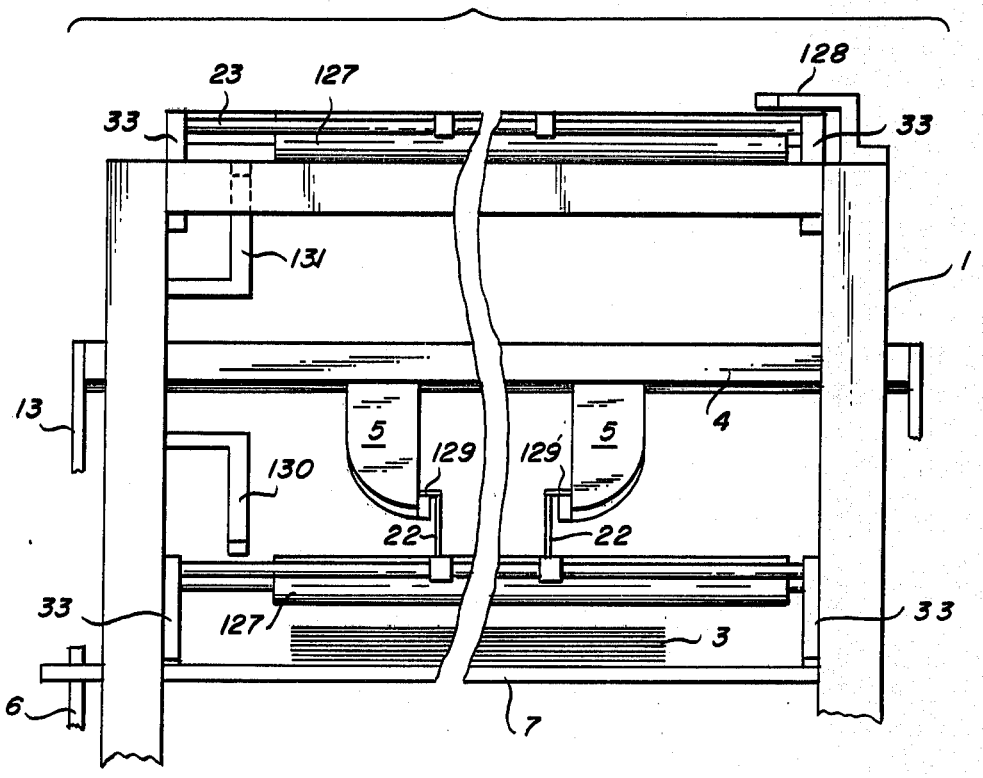
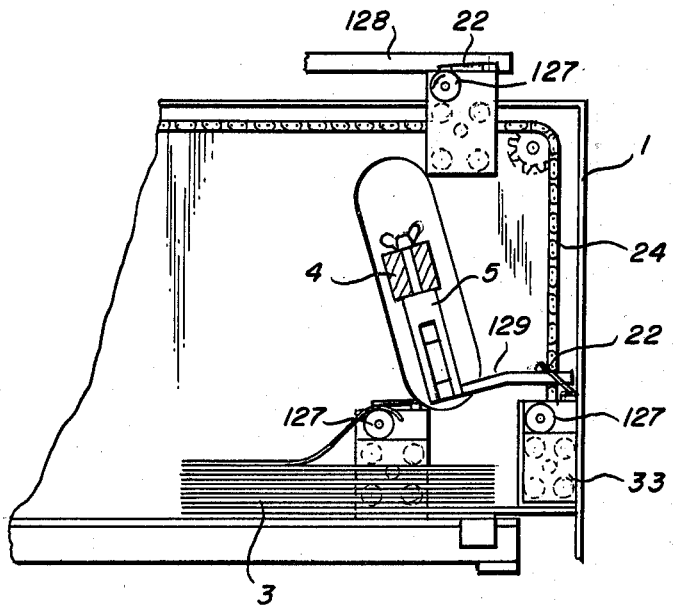
Fig. 5b

METHOD AND APPARATUS FOR THE SEPARATION OF FLEXIBLE SHEETS FROM A STACK AND THEIR TRANSPORTATION TO A PROCESSING UNIT

The present invention relates to an improved method and apparatus for the separation of flexible sheets from a stack and their transportation to at least one processing unit.

Already many attempts have been undertaken to automate the feeding of flexible sheets from a stack to a processing unit, for example stitching machines for serial production of ready-made clothing. In the fabrication of ready-made clothing, it is conventional practice to cut or punch to pattern an entire stack of garment sections. Generally, in a subsequent production operation such as stitching, the thus cut sheets are removed one at a time from the stack and transported to the desired production unit. So far this operation has involved considerable manual labor and automation is becoming an urgent necessity.

One of the chief benefits offered by an automation process is the infallible separation of the sheets from the stacks of precut fabric strips without buckling, shifting or disordering the underlying stack of sheets as a result of hitching with the sheet which is being removed. Such hitching may be caused for instance by the hairiness of the sheet surfaces, electrostatic charges, or by the sticky nature of the sheet finishing. An adequate solution to this problem is offered by the application of pick-up heads such as those described in U.S. Pat. Nos. 3,981,495 and 4,119,306 of Gaspar Bijttebier. In essence, according to these patents, the sheet stack is compressed near its opposite edges by the pressure shoes of the pick-up heads, whereafter pricking elements having oblique downwardly projecting needles are rotated downwards between the pressure shoes of each pick-up head in order to pick up the sheet (or sheets) to be separated. The pricked sheet is slightly tightened between the projections to separate it from the underlying sheets and finally the separated sheet is lifted from the stack by means of the pick-up heads. In the ready-made clothing industry it often occurs that fabrics with different design, dimensions, and material properties such as texture, specific weight, surface roughness, compressibility, stiffness, elasticity, etc. are to be handled. For example, a simple shirt already consists of 12 precut sheet members of different shapes. If the process involves the serial production of the shirt in one type of material and for the 20 usual sizes, then no less than 240 different stacks are necessary. The universal applicability of the gripping device, and particularly of the pick-up head thus becomes an essential requirement. The pick-up heads referred to in the following description are adjustable for working conditions, and, moreover, may be equipped with auxiliary devices for the reliable separation of sheets from stacks comprising sheets with different material and structural properties, without there being necessity to readjust the pick-up heads each time. The auxiliary devices and the related processing instructions are extensively described in Begian Pat. No. 848,591 of Gaspar Bijttebier.

Another important problem relating to this automation concerns the mechanical registering of the removed sheet on the transportation platform to the processing unit. Indeed, in most cases the sheet must reach the feeding mechanism of the processing unit in an accurate predetermined position. U.S. Pat. No. 4,119,306 offers principal solutions to this problem also in the form of, inter alia, a vibration mechanism: the supporting plate on which the separated sheet is deposited and which is mechanically removed from under the pick-up heads can be vibrated horizontally so that the sheet starts to slide against the positioning stops provided in the desired positions on the plate.

However, the horizontal forward and backward sliding movement of the supporting plate (sheet separating element) according to U.S. Pat. No. 4,119,306, and for example also according to U.S. Pat. No. 3,940,125, has a number of disadvantages. To begin with, the operation is relatively slow since the pick-up heads cannot perform a removal operation between the forward and backward movement time interval. When it is intended to achieve efficient automation of the feeding to the processing units for the fabrication of garments from stacks of sheets, then the duration between two successive removal operations must be brought down to 3 secs, or even lower, since the processing time itself, e.g. for punching sheets, must not exceed 1 sec.

Another disadvantage is that in lifting a sheet gripped in its corners, the separation involves a drawing loose from the stack, which, particularly in the case of the fast removal of for example hairy materials, does not exclude the danger of local disarrangement or buckling of the uppermost stack sheet which still awaits removal.

It is also desirable to have alternatively a sheet laid down on the registering mechanism in its position as on the stack and a sheet turned upside down when laying it down onto this mechanism before transporting it to the processing unit.

It is an object of the invention to provide a process and apparatus whereby the aforementioned disadvantages are effectively obviated and whereby fast and infallible automatic transportation of flexible sheets from stacks to processing units becomes possible, eventually with alternatively turning the removed sheets upside down. As the transportation to a processing unit always includes an exact positioning or registering of the removed sheet(s), the invention necessarily comprises measures and means to carry out this registering operation.

An essential feature of the process according to the invention is that the sheet (possibly sheets) is gripped near one of its (their) edges and removed from the stack according to the process described in Belgian patent No. 848.591 and that the thus picked-up sheet edge is gripped by means of suitable removal elements by which it is carried away in a horizontal direction at least beyond the pick-up area, so that the sheet is being progressively turned and rolled away from the stack and transported towards a registering mechanism.

The process avoids any drawing loose of the sheet. The removal elements thereby preferably hold the gripped sheet edge more or less stretched so that the separation between sheet and stack takes place according to a gradually progressing straight line.

A second important feature of the process according to the invention, namely the replacement of the previously used forward and backward movable supporting plates by substantially lath-shaped removal elements, has, interalia, as a consequence that the duration of the processing cycle can be basically reduced. Indeed, as soon as the removal elements have passed under the pick-up heads with the sheet rolled away from under the latter, the heads can be returned to the stack to start, if so desired, a new removal cycle. When, in the meantime, the picked-up sheet has not yet been fully rolled off the stack, the result will be that, during part of the duration of the rolling-off operation, the stack will be held under the pick-up heads near its edge.

This may have the additional advantageous effect of preventing the rolling off sheet from pulling along underlying sheets (e.g. at considerable rolling off speeds or with strongly hitching sheets).

In a further basic step, the process according to the invention involves guiding the rolled-off sheet over a registering plate by means of the removal elements and there depositing and registering the sheet before transporting it to the processing unit. According to the construction setup, the sheet may or may not be turned upside down versus its position on the stack, and so be deposited on the registering plate. Next, the sheet is slid against at least one adapted positioning stop on the plate in an arbitrary, perliminarily determined direction and then carried away from the plate towards the processing unit by suitable means. According to the invention, it is also possible to turn the deposited sheet on the plate in its plane through any desired angle (smaller than 360°) in order to give it a suitable orientation before it is slid against the positioning surfaces. The sheet, when lying on the registering mechanism can also be submitted immediately to treatments such as e.g., printing or pressing.

The means with which the sheet registered on the plate is carried away towards the processing unit will hereafter be called the feeding mechanism for the processing unit. According to preferred embodiments described hereafter, it is now possible to select the removal direction of the sheet away from the registering plate in an arbitrary manner. This is an additional important advantage which further increases the versatility of the invention.

In order to transport the sheet from the registering plate to the feeding mechanism, according to the invention the registering plate and the feeding mechanism are moved vertically towards each other and then again moved away from each other after that the sheet has been transferred to the feeding mechanism to enable the removal elements passing between the feeding mechanism and the registering plate to put down another sheet. Several sheets can be transported one at a time from the same registering plate to the feeding mechanism, and, when the feeding mechanism remains stationary between at least two successive transporting operations, a number of sheets can be brought together on the feeding mechanism. The sheets can also be brought together on the registering plate. A number of sheets, either singly or combined, can also be transported to the feeding mechanism from several registering plates, or from several positions one next to another on the same registering plate and, according to their mutual positions and processing speeds, a variety of feeding conditions can be set.

The characteristics of the invention will become apparent from the following description of some preferred embodiments, wherein reference is made to the accompanying drawings and whereby still further advantages will be clarified, in particular characteristics of the apparatus whereby the process according to the invention can be applied efficiently.

In the drawings,

FIG. 3 shows a mechanism for supporting the registering plate;

Figure 6A:
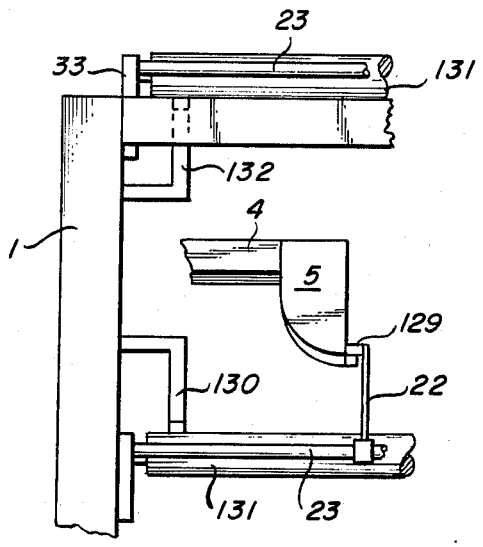
Figure 6B:
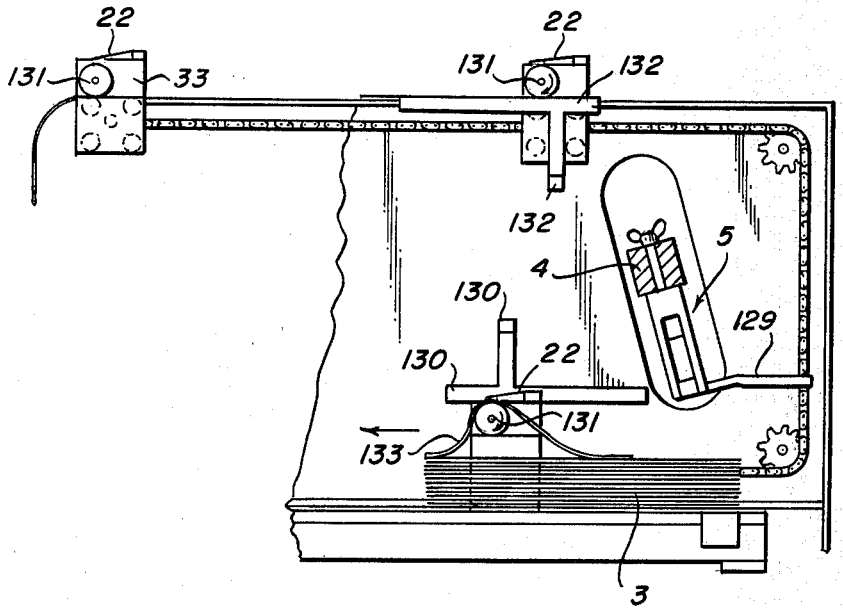
Figure 7:
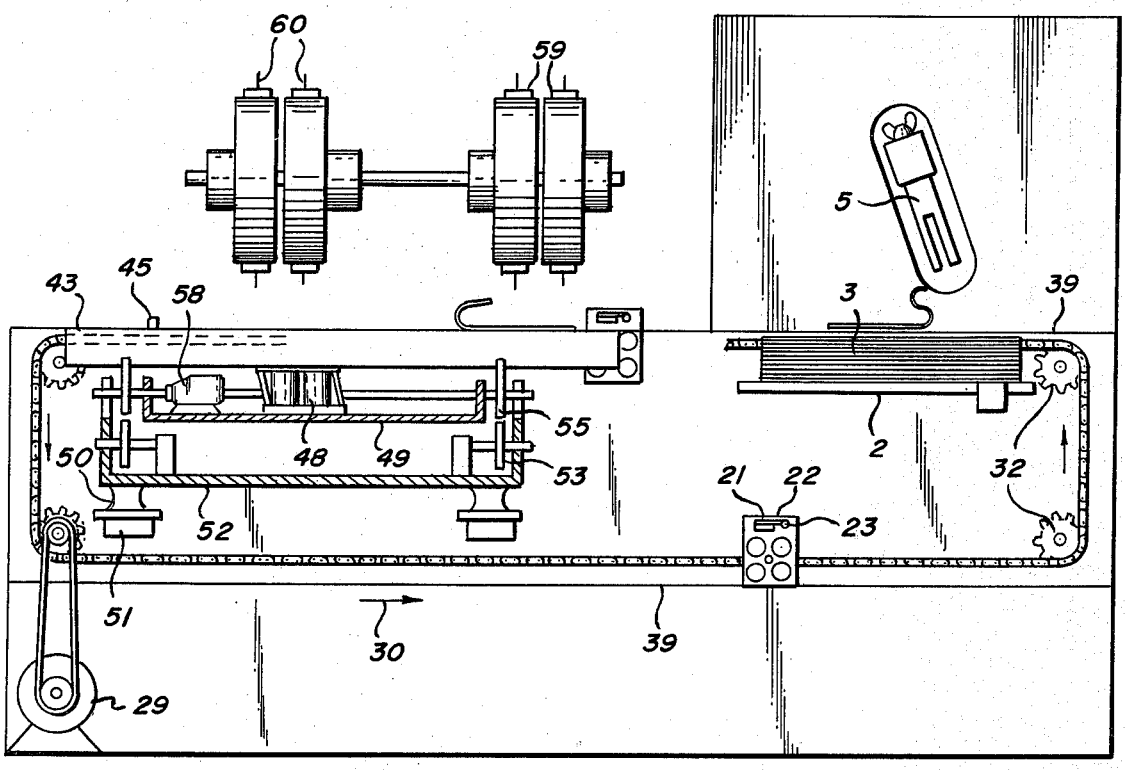
Figure 8:
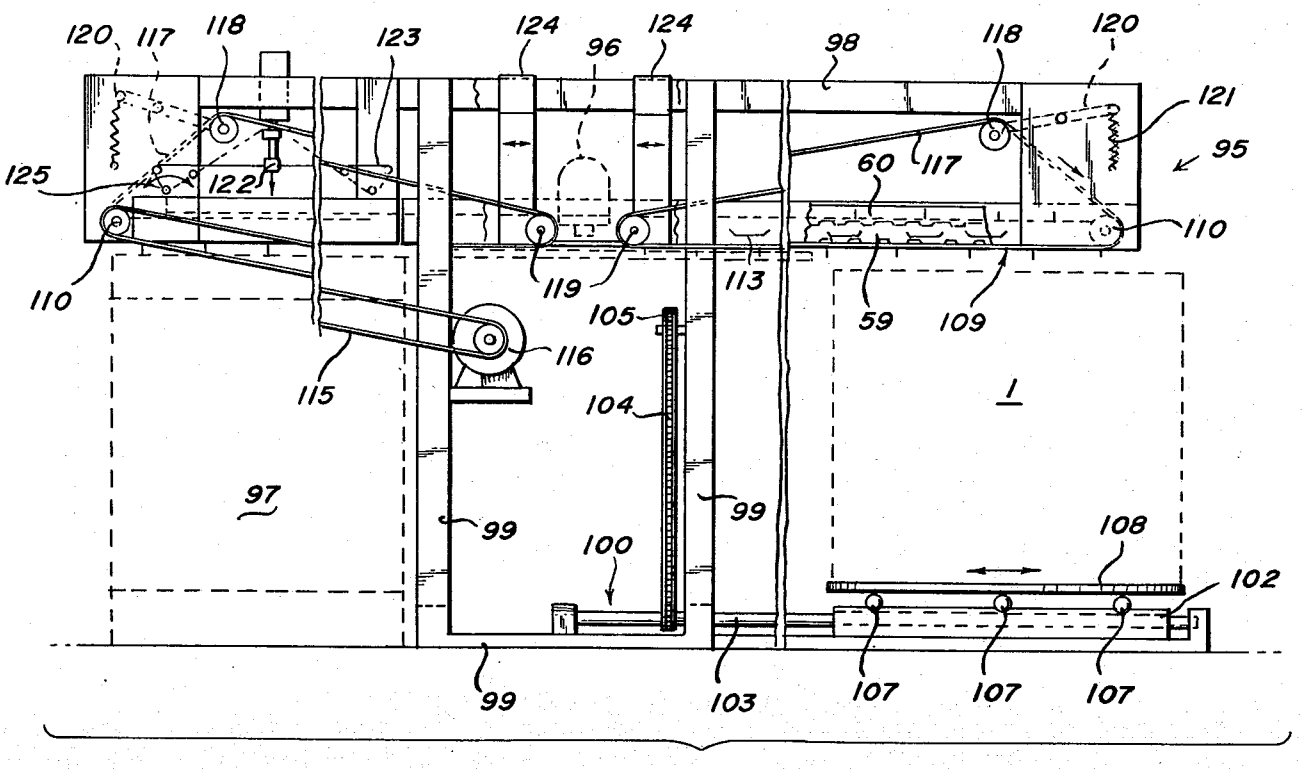
Figure 9:
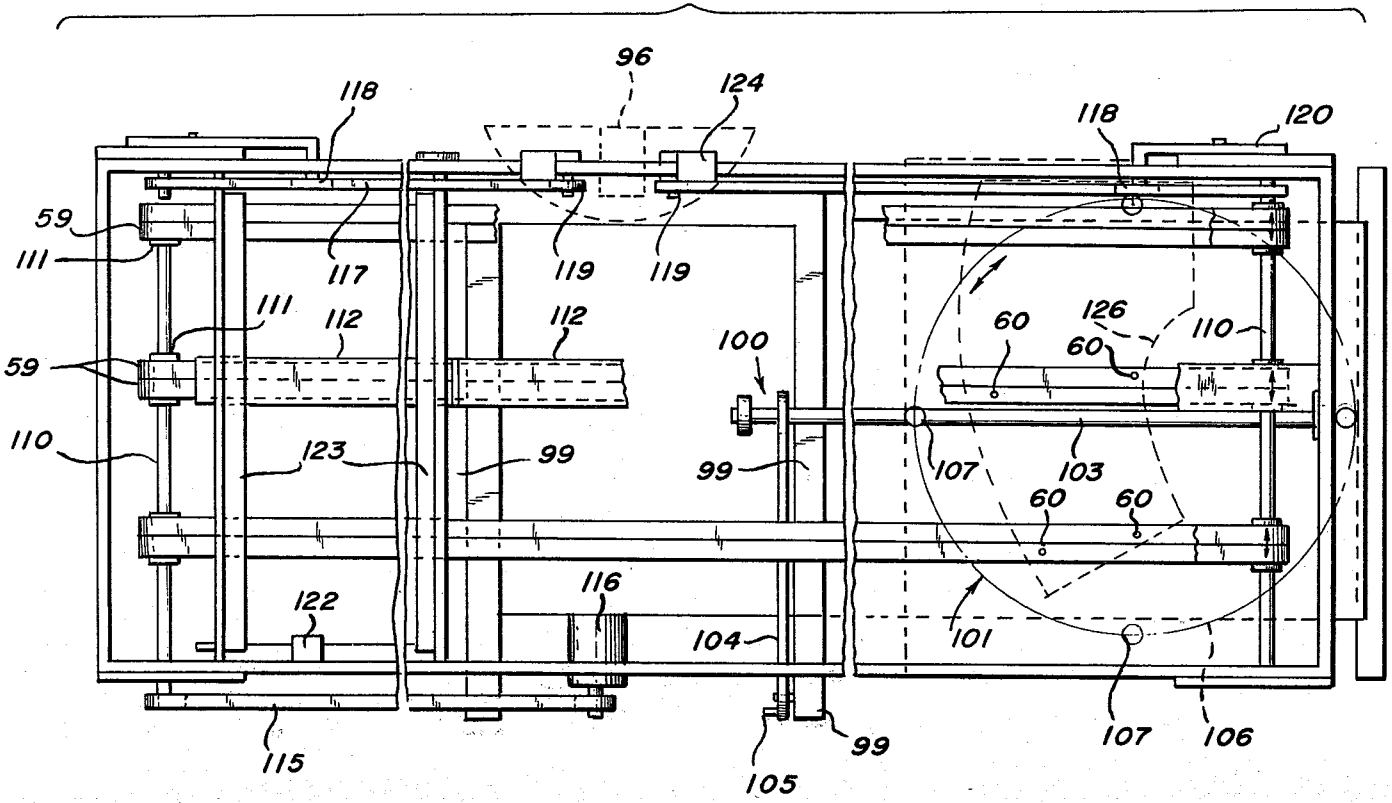

FIGS. 5*a* and 5*b* relate respectively to a front view and a side view of the apparatus wherein the removal elements comprise oblong rollers;

FIGS. 6*a* and 6*b* illustrate a similar removal element wherein the roll produces a reversal (upside down) of the sheet;

FIG. 7 shows another embodiment wherein the sheet is turned upside down on the registering plate;

FIG. 8 is a view of the processing unit feeding mechanism connected to the separation apparatus;

FIG. 9 is a top view of the feeding mechanism according to FIG. 8; and

FIG. 10 is an end view of the same feeding mechanism with a cross sectional detail enlargement of the conveyor belts held between their guiding means.

Figure 1:
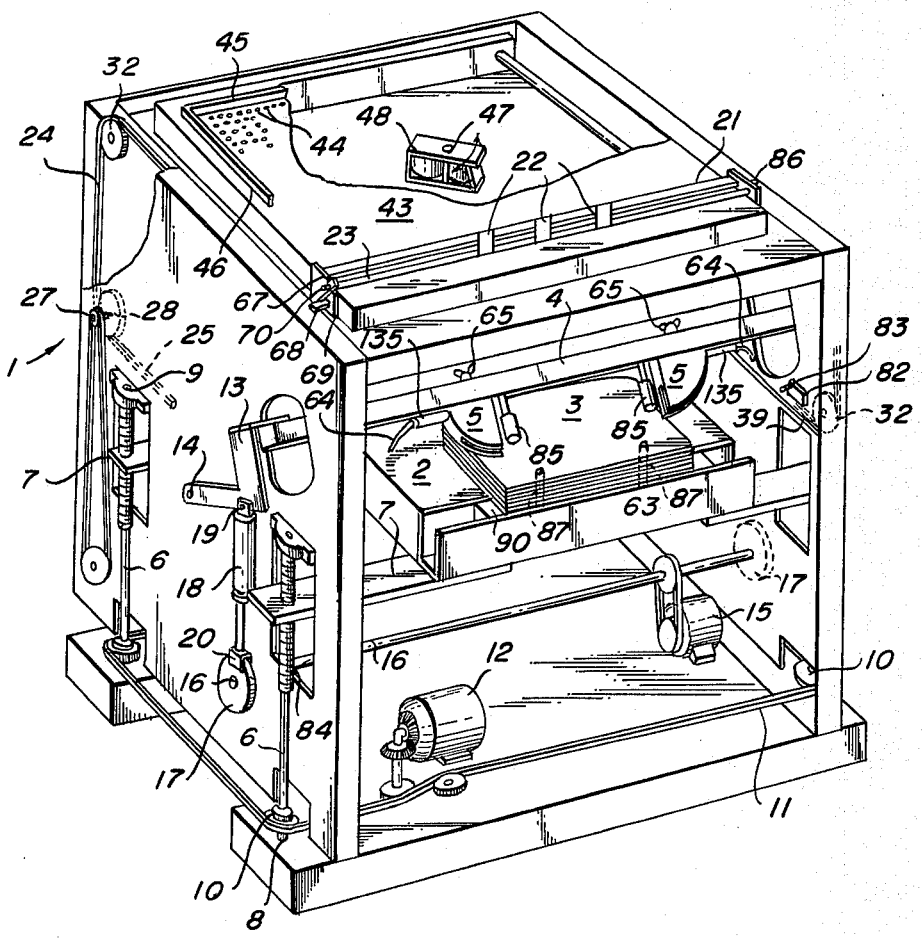
FIG. 1 is a perspective view of one of the preferred embodiments according to the invention.

The apparatus as illustrated in FIG. 1 comprises a frame 1 with a vertically movable table 2 which carries the sheet stack 3 and over which an up-and-down movable system 4 is mounted to which two pick-up heads 5 are adjustably fixed over the stacking edges by means of, for example, wing nuts 65. The pick-up heads 5 are preferably of the type described in U.S. Pat. Nos. 3,981,495 and 4,119,306. Also needle holders 85 may be provided whose function is extensively described in Belgian Pat. No. 848,591. The apparatus further comprises suitable means for moving towards each other the pick-up heads and the stack. The table 2 is vertically movably mounted on screw-threaded 84 rods 6 via supporting elements 7 provided with screw-thread bores which receive the rods 6. The rods 6 are attached to the frame via bearings 8 and 9 and can be caused to rotate by a motor 12 via gears 10 and the horizontally circulating chain 11. During this rotation the table 2 translates vertically as a result of the screw thread connection between the rods 6 and the supporting elements 7. The system 4 with the pick-up heads 5 can also tilt up and down around a horizontal shaft 14 via end connecting elements 13. This movement is transmitted from motor 15 to shaft 16 to whose ends discs 17 are fitted on which members 18 are mounted in hinged and eccentric fashion to provide hinged connections 19 with the elements 13. The removal elements for the gripped sheet 61 move horizontally between the stack upper surface and the undersides of the pick-up heads 5 and contain clamping means 22 for the sheet 61. These elements preferably consist of a horizontal lath 21, which at both it sides is fixed to circulating chains 24, 25 respectively and to clamping plates 22 which coact with said lath and which are fixed to a rotatable shaft 23 in an adjustable manner. The shaft 23 is fixed to a lever arm 67 in 69, which arm can rotate about pin 70.

Figure 2:
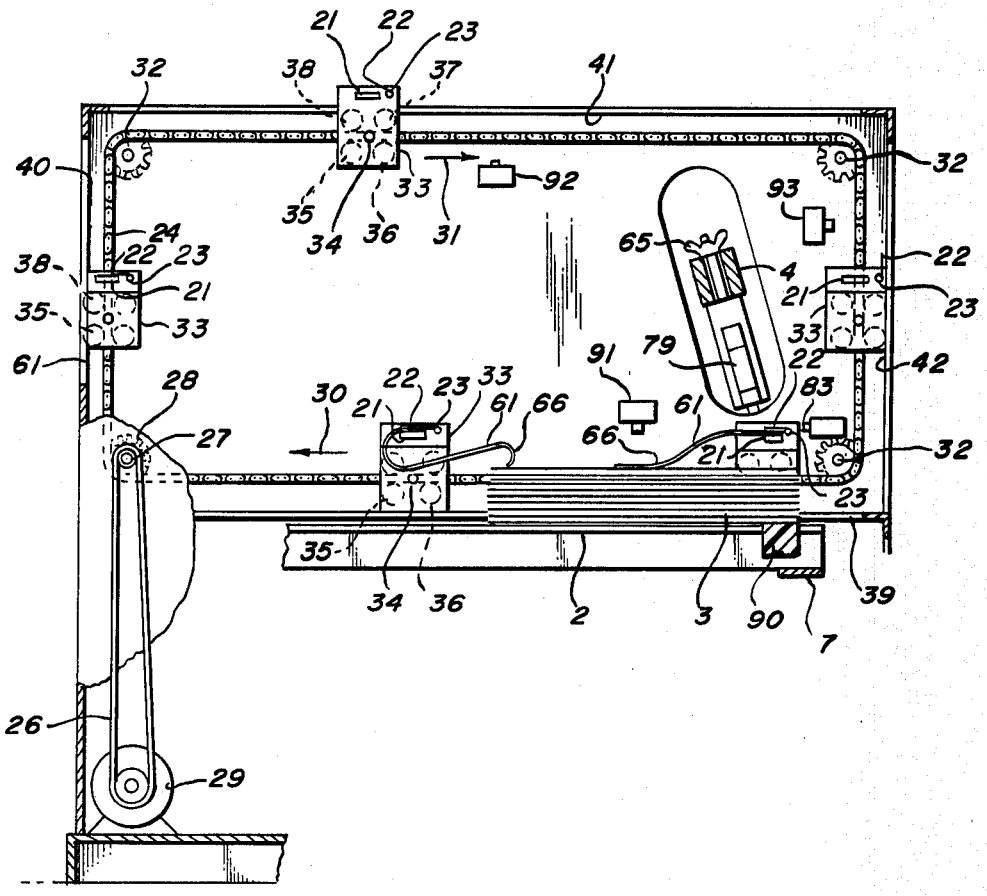
FIG. 2 is a schematic view of the circulation of the removal elements in this apparatus.

As shown further in FIGS. 1 and 2, the chains 24, 25 are circulated over guiding rollers 32 by a motor 29 via a chain transmission 26 and a joint shaft 27 provided with toothed wheels 29. The ends of the removal elements fixed to the chains thereby translate through a rectangular path with a lower horizontal course 30 right above the sheet stack and an upper horizontal course 31. For the sake of this translation, the ends of the removal elements are, e.g. provided with vertical plates 33, which are fixed to the chains 24 and 25 respectively by means of a central pin 34, and on which some four guiding wheels 35, 36, 37, 38 are mounted.

When these chains are in circulation, the wheels 35 and 36 roll during the course 30 on the guiding lath 39 mounted in the frame, while the wheels 35 and 38 roll against the inner side 40 of the vertical frame during the transition from course 30 to course 31. The guiding wheels 37 and 38 follow the underedge 41 of the frame in course 31, whereas the wheels 36 and 37 roll against the other vertical inneredge 42 of the frame during the vertical downward translation from course 31 to 30. Thus the removal elements are prevented from axial rotation with respect to the frame 1 during circulation on the chains 24, 25.

When circulating through the upper course 31, the removal elements 21 are guided right over a registering plate 43, which plate is an essential part of the apparatus since it is necessary to bring the removed sheets always in an accurate predetermined position to the processing unit. The plate 43 has a flat surface and is preferably provided with apertures 44 and positioning stops 45 and 46. A foil may be glued to the plate covering the not used apertures 44 in the plate to avoid hitching of the sheets when sliding over the apertures. The foil may, e.g., be a rubber-like ply with a smooth surface. In its center 47 the plate 43 is fixed to a vibration element 48.

FIG. 3 more clearly shows how the plate 43 can be connected to the frame. The vibration element 48 which supports the plate 43 is fixed to a supporting plate 49 in an orientable fashion, which supporting plate 49 is connected directly or indirectly via shock-absorbing cushions 50 with supporting elements 51 fixed to the frame. The supporting plate 49 can be indirectly connected with the frame 1 by means of a supporting frame 52 which is fixed to the shock-absorbers 50. This supporting frame is then equipped with suitable supporting elements 53 for plate 49. The supporting frame 52 also comprises, e.g., vertical guiding slots 54 in which the plate can slide up and down. The up-and-down movement is possible when, e.g., the supporting elements 53 are rollers and when the supporting plate 49 is provided with turnable cams 55 which rest on the supporting rollers 53 and whereby the cam ends 56 extend in the slots 54. The camshafts can be interconnected by a chain transmission 57 and their rotation is for example driven by a motor 58.

The right section of FIG. 3 shows the lowest position of the camshaft 56, and hence of supporting plate 49, vibration element 48 and registering plate 43. In this position, the removal elements 22, 23 can be passed over the plate 43.

The left section of FIG. 3 shows the situation wherein the plates 43 and 49 have been slid upwards (highest position of the camshaft 56). In this section, the presence has been suggested of a circulating conveyor belt 59, which is provided with projecting needles 60 for picking up the sheet 61 registered on the plate 43. Stopping the belt 59 is so regulated that each needle 60 is in vertical position over an aperture 44 in the plate. Said conveyor belt 59 is an essential component of the actual feeding mechanism to the unillustrated processing unit (eg. a stitching machine).

The successive operations of this automatic preferred embodiment, as well as the ensuing particularities and advantages of this process will now be further described with reference to the drawings.

Figure 4:
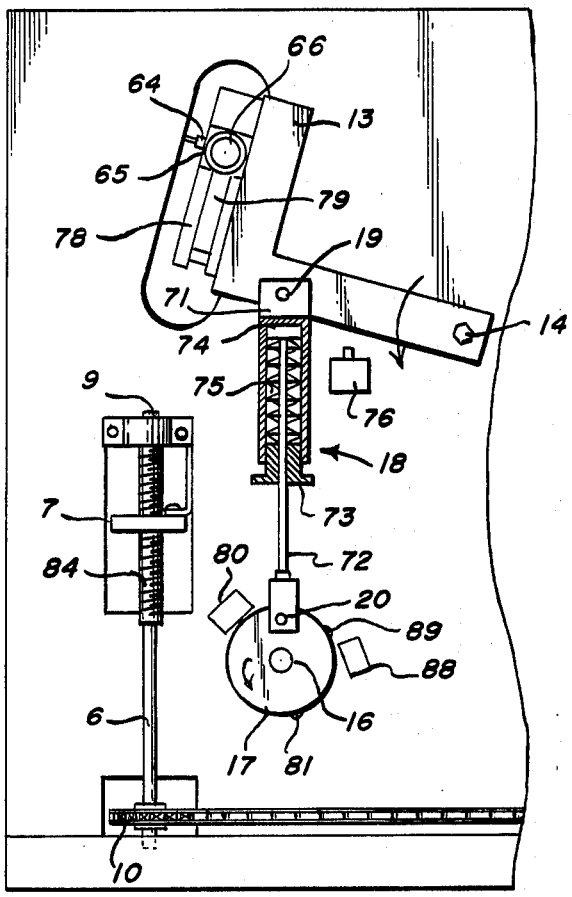
FIG. 4 is a detailed view of the removal mechanism and its control.

The prickling phase of the sheet takes place as described in Belgian Pat. No. 848,591: the stack 3 is preferably locally compressed near a straight edge 63 by the pick-up heads 5 which rotate downwards about the shaft 14. The rotating movement of the system 13 is driven by disc 17 via the driving rod 18 which is slightly springing in its lengthwise direction, as illustrated in FIG. 4. It is composed of a sleeve 71 in which a spring-loaded piston rod 72 can slide. At the bottom, the sleeve is closed with a stop 73 with a central bore, which forms a passage for rod 72. Between the stop 73 and piston rod 74 there are, e.g., a suitable number of belleville washers 75. As the sheet stack gets thinner (when a number of sheets have been removed), the system 13 will have to tilt down deeper. To avoid the axial spring tension in the combined driving rods (and hence the pressure on the stack edges) dropping too much an electrical sensing element 76 is fitted in the vicinity of element 13. As soon as a given depth level has been reached the element 13 closes an electrical contact in the sensing element 76, which contact actuates motor 12 to screw up the plate 2 on rods 6 in a suitable manner.

After the stack has been compressed to a maximum degree under the pressure shoe pairs 78 of the pick-up heads 5 with pin 20 then in vertical position under shaft 16, the pricking elements 79 are tilted downwards under the influence of presssurized air fed to the pressure cylinders 135 through pipes 64. The movement of the prickling elements is controlled by an electric contact which is closed in a control element 80 by means of a suitable cam 81 at the edge of the disc 17. The picked-up sheet is slightly tightened near its edge 63 and separated from the stack and lifted when the system 4 with the heads 5 is tilted upwards. To prevent the disc 17 from continuing its turning movement an interrupter contact 88 is actuated by the cam 89 so switching off motor 15.

Now the lath-shaped removal element 22 driven by chains 24, 25 is passed horizontally through course 30 between the stack upper surface and the lifted edge 63. The pricking elements 79 in heads 5 are retracted at the command of a similar electric control element 82, which is switched on by lath 21, so that the sheet edge is released by the heads and falls onto the lath 21. Immediately afterwards, the clamping means 22 is rotated about shaft 23 and is lowered onto the lath as the lever arm 86 hits against a stop 83 provided in a suitable manner in the frame. The sheet edge so clamped by the removal element is carried away from under the head 5.

During the further removal of the gripped sheet edge through course 30, the sheet is thus bent above the stack as shown in FIG. 2, and is rolled away in horizontal direction over a progressing line 66, which is substantially parallel to the line connecting the clamping places of the gripped sheet edge. The consequence of this operation is that the separation of the gripped sheet from the stack takes place progressively over a line with minimal force.

According to the invention, the transportation of the picked-up sheet edge 63 from the pick-up heads to the removal elements has proved to be a very advantageous measure: during the separation it is indeed visible that the sheet is drawn loose from the stack beyond the separation zone over a substantial part of its surface (see, e.g., FIG. 2). As soon as the sheet is taken over by the horizontally moving removal elements, the process of turning the sheet upside down starts and as a result the sheet section that is drawn loose moves backwards to form a loose loop. When the sheet is further rolled off and the loop has become plane and the remainder of the sheet is gradually separated from the stack, then, for the sheet section to be rolled off last, a possible separation resistance will be exerted on the stack a distance away from the separation area and hence exert no influence on the stack section in the separation zone.

As soon as the sheet has been rolled away from under the removal elements, the pick-up heads 5 can again be lowered onto the stack, if only to hold the stack near its edge to prevent it from being dragged along by the rolling-off sheet: the signal thereto for motor 15 is given by, e.g., the guiding wheel 38 which in the action closes a contact in the control element 91. The underlying sheet is also efficiently prevented from being taken along by the rolling off sheet by the presence of anchoring needles 87 which are engaged into the stack and are pushed deeper progressively at or immediately after each compression on the stack by the elements 85, as further described in Belgian Pat. No. 858,591. In order to engage these anchoring needles deep enough, the stack edge to be compressed rests on a supporting cushion 90 provided in plate 2.

The removed sheet is now further led towards the upperside of the frame 1 in the direction of the chains 24 and 25, and according to course 31 pulled over the registering plate 43 which is in its lowest position. Before the removal element moves downward again, a stop 58 on the frame swings open the lever arm 67 with the connected clamping plates 22 so that the sheet edge is released and the sheet stays lying on the plate 43. The guiding wheel 36 in passing now closes the contact 92 whereby the vibration element 48 is actuated to register the deposited sheet correctly on the plate. A suitable vibration element is, e.g., a vibration magnet of the "throw vibrator" type (e.g., Wurfvibrator Typ 24516/13A of the German Firm of Binder Magnete). The magnet may be placed in an arbitrary direction so that moving (translating) the sheet (in its plane) in any desired predetermined position is possible. The direction of vibration will preferably be so selected that the sheet is first slid with its longest side against the positioning stop 45, and then along this side (usually somewhat slower) it is slid further until a shorter side rests against the second positioning stop 46. Therefore the angles formed between the direction of vibration and the second positioning stop 46 must be smaller than the angle formed with the first positioning stop 45. The vibration amplitude is preferably adjustable. This can be done with a potentiometer. The amplitude will generally have to be smaller accordingly as the sheet is lighter and/or smoother. The vibration frequency is 50 Hz. The slow sliding of a short sheet edge against its (second) positioning surface is very advantageous to prevent it from sliding over the stop. Indeed it has been experienced that light and very flexible sheets sometimes show the tendency to buckle against the stop or to slide over it when being vibrated too fast against it.

After the sheet has been vibrated into the correct position, the plate 43 is lifted under the influence of the cam mechanism 53, 55 controlled by motor 58: see FIG. 3. The motor 58 is switched on by the guiding wheel 35 closing a contact in the control element 93 (FIG. 2) and is so adjusted that it is switched off again when the cams 55 have rotated through 360° about the shaft 56. Preferably, simultaneously with the up-and-down movement of the plate 43, the vibration amplitude is decreased to zero. During the upward movement of the plate the sheet is pricked on the needles 60 projecting from the underside of the belt 59.

The ability to lift and lower the plate 43 offers an important gain in time to the process: as soon as the plate has been lowered again, the removal elements can again pull a sheet over the plate (and under the conveyor belt 59), while the sheet engaged by the needles 60 is removed from over the plate. In other words, it is not necessary to wait to pull a new sheet onto the plate until the preceding sheet has been fully removed by means of the feeding mechanism from over the registering plate.

The application of removal elements comprising an oblong roller (instead of laths 21) (as illustrated in FIGS. *5a, 5b, 6a, 6b*) has also turned out to be efficient, in particular when in turn sheets are deposited inverted on the registering plate.

The path of the removal element which deposits the sheet not inverted on the registering plate is shown in FIGS. *5a* and *5b*, whereas the path of the other removal element on the chains which deposits the next sheet inverted on the plate 43 is shown in FIGS. *6a* and *6b*. Instead of lath 21, FIGS. *5a* and *5b* now show a roller 127 with, e.g., a ribbed rubber surface between the plates 33 fixed on the circulation chains 24, 25. Furthermore, a rod 129 is fixed to each pick-up head which serves as a stop for the clamping hooks 22. Now, when the removal element in the apparatus reaches its downward course beyond the pick-up heads, the clamping hooks 22 are lifted by the rods 129 from the roller 127. When then the removal elements pass horizontally under the pick-up heads (which engage the lifted sheet edge 63), the clamping hooks 22 slide over the rods 129. When the ends of the rods are reached, the hooks 22 swing downward onto the sheet edge 63 which, in the meantime, has been released from the pick-up heads and has fallen onto roller 127. In this way, this sheet edge is clamped between the roller surface 127 and the spring-loaded clamping hooks 22. The removal element rolls the sheet away as described before and pulls it onto the registering plate 43. For releasing the sheet edge from the removal element over plate 43, a horizontal guiding plate 128 has been provided against which the end of roller 127 rests and which rotates the roller in the indicated direction so that the gripped sheet edge is unfolded between the roller surface and clamping hooks 22.

When, in turn, a sheet is to be positioned upside down on the registering plate 43 relative to its prior position on the stack, the other removal element fixed to chains 24, 25 will comprise a roller 131. When this roller has passed under the pick-up head with the gripped sheet edge 63 turned upside down, it is rolled with its end against a horizontal guiding rod 130 mounted in the frame of the apparatus. The separated sheet is thus forced to pass between the clamping hooks 22 and the roller surface. The rod 130 is adjustable for length and is set in such a way that the contact with the roller end is broken when the rear-side 133 of the sheet reaches the upperside of the roller under the clamping hooks 22. The sheet is now pulled from the stack with its gripped rear-edge 133 and brought to the registering plate where it is deposited upside down. For releasing the sheet, the roller 131 rolls with its end against a guide 132 mounted in the frame so that the gripped edge 133 is released from between the roller and the hooks 22.

An alternative construction is shown in FIG. 7. The registering section is now located beside the separation section of the apparatus instead of over it. Its operation is illustrated in the figure. FIG. 7 also shows a cross-section of supporting plate 49, supporting frame 52, and the cams 55 which are driven by the motor 58 and rest on rollers 53 and which produce the lifting and lowering movements of the registering plate 43 and of the vibration magnet 48 attached thereto.

The invention also relates to a feeding mechanism for the processing units, which mechanism is preferably adjustably connected with the aforesaid pick-up and registering apparatus 1 for the separated sheet.

An advantageous embodiment of this feeding mechanism 95 is shown in FIGS. 8, 9 and 10. It is preferably mounted on a stand 99 and comprises a frame 98 in which conveyor belts 59 are mounted so that they extend on the one hand over the registering plate 43 of the mechanism 1 and on the other hand come in the vicinity of the processing units: e.g., a stitching machine 96 and a restacker 97. The connecting means 100 enables the mechanism 1 to translate parallel to the conveyor belt direction by shifting the car 102 which carries the mechanism 1 mounted on the platform 108, e.g., via a screw thread connection with guiding rod 103. This move can be achieved in a known manner (and is therefore not further illustrated) through rotation of the screw-threaded rod 103 about its axis. This rotation can be manually transmitted by 105 to rod 103 via the chain connection 104.

A connecting means 101 is necessary for the adjustment of the angle of orientation of the mechanism 1 versus the longitudinal direction of the conveyor belts. Therefore the car 102 is provided with a suitable circular rail 106 in which for example the rollers or ball wheels 107 attached to the underside of the platform 108 may run. Thus it is possible to move the registered sheet from the plate in a predetermined arbitrary orientation with respect to the feeding mechanism towards the processing unit.

Shafts 110 are bearing-mounted in the ends of the frame 98. The circulation roller pairs 111 for the conveyor belts are axially slidably mounted on these shafts. Each toothed conveyor belt 59 running over equally toothed rollers 111 can be set in any arbitrary position in its lengthwise direction in order to adapt the relative position of needles 60 in the diverse neighboring belts to the shapes and dimensions of the sheets to be picked up. This feature is suggested by a sheet contour 126 in FIG. 9 and highly increases the universality of the feeding mechanism.

The conveyor belts 59 are preferably seized between adapted guiding means 109 as shown in the detail enlargement in FIG. 10. These means 109 comprise, e.g., vertical plates 112 which are connected with the frame 98 in a suitable manner and support the belts 59, so that the latter go through an accurate longitudinal path from which they cannot deviate, neither vertically nor laterally. This is essential to assure accurate feeding to the processing unit. This accurate guiding is also guaranteed by horizontal guiding means 113 and 114 situated respectively over and under the belt section running below.

The operation of the feeding mechanism will now be clarified with reference to an example wherein the processing unit 96 is a stitching machine and 97 a restacker. At the outset let us assume that the belts 59 are standing still and that a sheet is pricked on the needles 60 by means of the plate 43. The belts 59 which carry the sheet are now driven by a motor 116 via belt transmission 115 at a speed equal to the stitching speed of the unit 96. When the belt has progressed so far that a second sheet can be picked up on the belt after the first one (without overlapping in the stitching area), then the belts stop again for picking up a second sheet. When the belts start again, the first sheet runs under the stitching head and the edge is stitched. Now the belts stop again, and, during this standstill, the stitching thread is cut through and at the same time a third sheet is picked up by the registering plate. When the belts start running again the second sheet is stitched. At the next stop three operations take place simultaneously: the first (stitched) sheet is pushed down from the needles over the stacker 97, the stitching thread is cut off at the back edge of the second sheet, and the plate 43 pricks a fourth sheet on the needles. This shows that a same idle time (belt stop) serves three purposes, in other words, that a minimum of time is lost with the automatic feeding mechanism according to the invention. This feeding method also shows that the distance between the apparatus 1 and the unit 96 needs regulation by the aforesaid means 100 as a function of the length of the sheet zone which is to progress beyond the stitching head taking account of the presence of at least one reserve sheet between the mechanisms 1 and 96.

In order to carry the sheet edge to be stitched accurately beyond the stitching head it is often necessary to mount additional guiding belts 117 in the frame 98, which belts run over wheels 118, 119 and whereby the position of both wheels 119 is adjustable (by shifting the holders 124 on the frame), on the one hand, to leave a suitable free space for the unit 96 between both, and, on the other hand, to adapt the relative position of the unit 96 to the dimensions of the sheets to be processed. Since the belt lengths 117 stay unchanged, the relative shifting of wheels 119 also involves a shifting of wheels 118. The wheels 118 are also constantly spring loaded via a lever attachment 120 so that the belts 117 always stay stretched.

The aforementioned pushing-off of the processed sheet over the restacker 97 is generated by the parts of the guiding means 109 situated over this unit, which can be achieved by means of for example a mechanism 122, 123. This mechanism comprises, e.g., a pneumatically operated rod 122 which can move up and down the connected belt guiding means 109 via a connection with members 123 that are rotatable about horizontal shafts 125.

It is evident that the control signals for stopping the belts (motor 116), cutting the thread (unit 96), and pushing off the sheet (pneumatic member 122) must be synchronized with the upward movement of the plate 43 controlled by the element 93.

The feeding mechanism may also be adapted to transport e.g., sheets from two or more sequenced separation apparatuses 1 (e.g., combined) to the processing units. The distance between the diverse separation apparatuses and their orientation will then have to be adapted to the sheet dimensions.

It is also possible to mount in apparatus 1 two or more pairs of pick-up heads 5 on the system 4 in order to pick up sheets from two or more adjacent stacks 3 and to carry them away. The registering plate will then be subdivided into an equal number of independent sections (as stacks) each having its own vibration magnet 48 and its own registering stops 45 and 46, whereby the vibration movement to be exerted for the diverse plates can be applied in different directions.

If the sheets are to be rolled off with their short transverse dimensions in the rolling direction 30, then sometimes it may be advantageous to fix a registering plate 43 to the vibration magnet 48, which plate has an analogous short transverse dimension in the rolling-off direction 30. In this way, the number of removal laths 22 on the chains 24 and 25, and hence the gripping frequency, can be raised.

The mechanism to move the registering plate 43 up and down may be omitted, e.g., when the conveyor belts 59 are so made that the pins 60 can be moved up and down as far as into the apertures 44 of the plate 43.

The drive and control of the up-and-down movement of the table 2, the heads 5, the plate 43, and the circulation chains 24, 25 may, if so desired, be achieved by one motor and one control element through a constructive connection of the components eg. via cam mechanisms. The sheet stacks may, if so desired, be placed in forms.

In case a series of adjacent stacks of strip of which the lengthwise directions are parallel to the chains 24, 25 are to be separated, transverse arms can be mounted on the frame 4 over each stack. A couple of pick-up heads are then mounted on each transverse arm and each strip or the front end in lengthwise direction of each long strip is then lifted.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller and relatively movable with respect to said roller for engaging said roller by moving into contact with said roller and thereby gripping a sheet to be conveyed; and, means for rotating said roller at said registering plate to release the sheet from said roller and said clamping member and to deposit it on said registering plate.

2. A method for separating flexible sheets from at least one stack and transporting them individually to at least one processing unit, comprising:

compressing the stack at an edge thereof;

engaging the top sheet of the stack at the compressed edge and lifting the edge of the top sheet to a position spaced above the stack;

gripping the top sheet by the lifted edge with a horizontally disposed rotatable roller cooperating with a pivoting clamping member mounted parallel to said roller;

removing the top sheet from the stack by moving said roller and clamping member over the stack whereby the sheet is progressively turned and rolled off the stack; and, conveying the sheet to a registering means by said roller and clamping member, releasing the sheet from said roller and clamping member by rotation of said roller, and registering the sheet for transporting to at least one processing unit.

3. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member pivotably mounted on a shaft parallel to said roller for engaging said roller when pivoted and thereby gripping a sheet to be conveyed; and, means for rotating said roller at said registering plate to release the sheet from said roller and said clamping member and to deposit it on said registering plate.

4. A method for separating flexible sheets from at least one stack and transporting them individually to at least one processing unit, comprising:

compressing the stack at an edge thereof;

engaging the top sheet of the stack at the compressed edge and lifting the edge of the top sheet to a position spaced above the stack;

gripping the top sheet by the lifted edge with a horizontally disposed rotatable roller cooperating with a clamping member mounted parallel to said roller, said clamping member being adapted to engage said roller by moving into contact with said roller;

removing the top sheet from the stack by moving said roller and clamping member over the stack whereby the sheet is progressively turned and rolled off the stack; and, conveying the sheet to a registering means by said roller and clamping member, releasing the sheet from said roller and clamping member by rotation of said roller, and registering the sheet for transporting to at least one processing unit.

5. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit, said registering plate being situated vertically above said table in said frame;

pick-up means for engaging the top sheet of said stack at an edge thereof and lifting the edge to a position spaced above said stack; and, conveying means for transporting each sheet from said stack of said registering plate, said conveying means including two opposed endless chain means circulating in said frame at opposite sides thereof in rectangular paths having a portion over said stack and a portion over said registering plate, said conveying means also including means attached at each end to one of said chain means for gripping the top sheet of said stack by the lifted edge of the top sheet as the gripping means moves over said stack to roll the top sheet off the stack;

said gripping means comprising a horizontally disposed lath and a clamping member mounted parallel to said lath for engaging and disengaging said lath and thereby gripping and releasing a sheet to be conveyed.

6. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit, said registering plate being situated vertically above said table in said frame;

pick-up means for engaging the top sheet of said stack at an edge thereof and lifting the edge to a position spaced above said stack; and, conveying means for transporting each sheet from said stack to said registering plate, said conveying means including two opposed endless chain means circulating in said frame at opposite sides thereof in rectangular paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller for engaging said roller and thereby gripping a sheet to be conveyed.

7. The apparatus of claim 5 or 6 wherein said gripping means is prevented from axial rotation with respect to said frame while moving through the portions of the paths of said two endless chain means over said stack and over said registering plate.

8. The apparatus of claim 5 or 6 wherein said conveying means includes at least two gripping means for gripping successive sheets from said stack, said two gripping means having a distance therebetween on said two chain means greater than the transverse dimension of said registering plate as measured in the direction of travel of said two chain means.

9. The apparatus of claim 3 and including means mounted on said pick-up means for pivoting said clamping member upwardly to disengage said clamping member from said roller as said gripping means approaches the lifted edge of the top sheet and for bringing said clamping member into engagement with said roller to thereby grip the top sheet therebetween when said gripping means is in overlapping relation with respect to the top sheet.

10. The apparatus of claim 9 wherein:

said two endless chain means travel in endless rectangular paths in said frame with said gripping means travelling first vertically downward and then horizontally over said table;

said clamping member is always positioned to pivot downwardly to engage said roller; and, said pivoting means for said clamping member comprises at least one generally horizontally projecting rod member positioned to maintain said clamping member pivoted in an open position with respect to said roller by engaging said clamping member as said gripping means travels downwardly on said two chain means and causing said clamping member to travel along said at least one rod member as said gripping means travels horizontally over said table.

11. The apparatus of claim 10 or 9 and including means for rotating said roller at said table after said clamping member is brought into engagement with said roller with the top sheet therebetween whereby said gripping means passes along the top sheet, said roller rotating means at said table being adapted to stop the rotation with the top sheet engaged by said gripping means adjacent the trailing edge of the top sheet.

12. The apparatus of claim 11 wherein said means for rotating said roller at said registering plate is adapted to rotate said roller in the same direction as said roller rotating means at said table, said registering plate being situated vertically above said table in said frame with said conveying means adapted to transport the sheet in one direction over said table and in the opposite direction over said registering plate whereby the sheet is deposited inverted on said registering plate.

13. An apparatus according to claim 1, 3 or 5 and including means for vibrating said registering plate, said registering plate being mounted horizontally in said frame;

a support plate for said vibrating means and said registering plate, said vibrating means being orientably connected to said support plate; and, means connected to said frame for supporting said support plate, said supporting means including shock absorbing means.

14. The apparatus of claim 13 and including means for the up and down movement of said registering plate and said support plate, said supporting means having vertical guide slots for guiding the up and down movement of said support plate and said registering plate.

15. The apparatus of claim 14 wherein said supporting means includes support rollers and wherein said support plate includes rotatable cam means having cam shafts, said cam means resting upon said support rollers with said cam shafts positioned in said guide slots whereby rotation of said cam means causes the up and down movement of said support plate and said registering plate.

16. The method according to claim 2 or 4 wherein during said removing step the separation between the stack and the sheet takes place along a gradually progressing straight line.

17. The method according to claim 2 or 4 and including the step of compressing the stack at the previously compressed edge thereof during at least a part of said removing step.

18. The method according to claim 2 or 4 and including the step of depositing the sheet upside down on said registering means from its position on the stack.

19. The method according to claim 2 or 4 and including the step of sliding the sheet against at least one positioning stop on said registering means in an arbitrary predetermined direction.

20. The method according to claim 19 and including the step of turning the sheet through an angle of less than 360° on said registering means prior to said sliding step.

21. The method according to claim 19 and including the step of transporting the registered sheet to said at least one processing unit in an arbitrary predetermined direction.

22. The method of claim 2 or 4 and including the steps of moving said registering means having the sheet thereon vertically toward a feeding means for said at least one processing unit, transferring the sheet from said registering means to said feeding means, and then moving said registering means vertically away.

23. The method of claim 22 and including the step of transferring several sheets from several registering means to said feeding means.

24. The method of claim 22 and including the step of maintaining said feeding means stationary between at least two of said transferring steps to bring a number of sheets together on said feeding means.

25. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack; and, conveying means for transporting each sheet from said stack to said registering plate, said conveying means including two opposed endless chain means circulating in said frame at opposite sides thereof in endless paths disposed in vertical planes, said paths having a portion over said stack and a portion over said registering plate, said registering plate being situated above said table in said frame between said two endless chain means;

said conveying means also including means attached at each end to one of said chain means for gripping the top sheet of said stack by the lifted edge of the top sheet as the gripping means moves over said stack to roll the top sheet off the stack;

said gripping means comprising a horizontally disposed lath and a clamping member mounted parallel to said lath for engaging and disengaging said lath and thereby gripping and releasing a sheet to be conveyed.

26. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack; and, conveying means for transporting each sheet from said stack to said registering plate, said conveying means including two opposed endless chain means circulating in said frame at opposite sides thereof in endless paths disposed in vertical planes, said paths having a portion over said stack and a portion over said registering plate, said registering plate being situated above said table in said frame between said two endless chain means;

said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller for engaging said roller and thereby gripping a sheet to be conveyed.

27. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to roll the top sheet off the stack;

said gripping means comprising a horizontally disposed lath and a clamping member mounted parallel to said lath for engaging and disengaging said lath and thereby gripping and releasing a sheet to be conveyed;

means for feeding separated sheets to at least one subsequent processing unit; and, means for translational and rotational adjustment of the relative position of said frame with respect to said feeding means.

28. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller for engaging said roller and thereby gripping a sheet to be conveyed;

means for feeding separated sheets to at least one subsequent processing unit; and, means for translational and rotational adjustment of the relative position of said frame with respect to said feeding means.

29. An apparatus according to claim 27 or 28 wherein said feeding means comprises a conveyor belt mechanism extending over said registering plate and cooperating with said at least one subsequent processing unit.

30. An apparatus according to claim 29 wherein said conveyor belt mechanism includes:

a plurality of conveyor belts having projecting needles, said belts being arranged in pairs and being adapted for longitudinal adjustment with respect to one another for adjusting the relative positions of said needles between said belts; and, conveyor belt guide means for maintaining said belts in accurate longitudinal paths.

31. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to roll the top sheet off the stack;

said gripping means comprising a horizontally disposed lath and a clamping member mounted parallel to said lath for engaging and disengaging said lath and thereby gripping and releasing a sheet to be conveyed;

means for feeding separated sheets to at least one subsequent processing unit, said feeding means comprising a conveyor belt mechanism extending over said registering plate and having projecting needles; and, means for the up and down movement of said registering plate whereby a sheet on said registering plate is raised into contact with said needles after which said registering plate is lowered to receive the next sheet.

32. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller for engaging said roller and thereby gripping a sheet to be conveyed;

means for feeding separated sheets to at least one subsequent processing unit, said feeding means comprising a conveyor belt mechanism extending over said registering plate and having projecting needles; and, means for the up and down movement of said registering plate whereby a sheet on said registering plate is raised into contact with said needles after which said registering plate is lowered to receive the next sheet.

33. A method for separating flexible sheets from at least one stack and transporting them individually to at least one processing unit, comprising:

compressing the stack at an edge thereof;

engaging the top sheet of the stack at the compressed edge and lifting the edge of the top sheet to a position spaced above the stack;

gripping the top sheet by the lifted edge with a horizontally disposed lath cooperating with a pivoting clamping means mounted parallel to said lath;

removing the top sheet from the stack by moving said lath and clamping means over the stack whereby the sheet is progressively turned and rolled off the stack;

conveying the sheet to a registering means by said lath and clamping means and registering the sheet for transporting to at least one processing unit;

moving said registering means having the sheet thereon vertically toward a feeding means for said at least one processing unit;

transferring the sheet from said registering means to said feeding means; and, then moving said registering means vertically away.

34. The method of claim 33 and including the step of transferring several sheets from several registering means to said feeding means.

35. The method of claim 33 and including the step of maintaining said feeding means stationary between at least two of said transferring steps to bring a number of sheets together on said feeding means.

36. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed rotatable roller and a clamping member mounted parallel to said roller and relatively movable with respect to said roller for engaging said roller by moving into contact with said roller and thereby gripping a sheet to be conveyed; and, means for rotating said roller at said table after said clamping member is brought into contact with said roller with the top sheet gripped by said roller and said clamping member whereby said gripping means passes along the top sheet, said roller rotating means at said table being adapted to stop the rotation with the top sheet engaged by said gripping means adjacent the trailing edge of the top sheet.

37. The apparatus of claim 36 and including means for rotating said roller at said registering plate in the same direction as said roller rotating means at said table, said registering plate being situated vertically above said table in said frame with said conveying means adapted to transport the sheet in one direction over said table and in the opposite direction over said registering plate whereby the sheet is deposited inverted on said registering plate.

38. An apparatus for separating and transporting flexible sheets individually from a stack to at least one processing unit, comprising:

a frame having a vertically movable table for carrying said stack and a registering plate for receiving the sheets individually from said stack and for orienting each sheet for delivery to said at least one processing unit;

pick-up means for engaging the top sheet of said stack at an edge thereof and lifting the edge to a position spaced above said stack;

conveying means for transporting each sheet from said stack to said registering plate, said conveying means including two opposed endless chain means circulating in said frame at opposite sides thereof in paths having a portion over said stack and a portion over said registering plate, said conveying means also including means attached at each end to one of said chain means for gripping the top sheet of said stack by the lifted edge of the top sheet as the gripping means moves over said stack to remove the top sheet from the stack;

said gripping means comprising a horizontally disposed roller and a clamping member pivotably mounted on a shaft parallel to said roller for engaging said roller when pivoted and thereby gripping a sheet to be conveyed; and, means mounted on said pick-up means for pivoting said clamping member upwardly to disengage said clamping member from said roller as said gripping means approaches the lifted edge of the top sheet and for bringing said clamping member into engagement with said roller to thereby grip the top sheet therebetween when said gripping means is in overlapping relation with respect to the top sheet.

39. The apparatus of claim 38 and including means for rotating said roller at said table after said clamping member is brought into engagement with said roller with the top sheet therebetween whereby said gripping means passes along the top sheet, said roller rotating means at said table being adapted to stop the rotation with the top sheet engaged by said gripping means adjacent the trailing edge of the top sheet.

* * * * *